US007940881B2

(12) United States Patent
Jongen et al.

(10) Patent No.: US 7,940,881 B2
(45) Date of Patent: May 10, 2011

(54) DEVICE AND METHOD FOR PRODUCING RADIOISOTOPES

(75) Inventors: Yves Jongen, Louvain-la-Neuve (BE); Jozef Comor, Zemun (YU)

(73) Assignee: Ion Beam Applications S.A. (BE)

( * ) Notice: Subject to any disclaimer, the term of this patent is extended or adjusted under 35 U.S.C. 154(b) by 839 days.

(21) Appl. No.: 10/537,975

(22) PCT Filed: Dec. 10, 2003

(86) PCT No.: PCT/BE03/00217

§ 371 (c)(1),
(2), (4) Date: Jun. 9, 2005

(87) PCT Pub. No.: WO2004/053892

PCT Pub. Date: Jun. 24, 2004

(65) Prior Publication Data

US 2006/0104401 A1 May 18, 2006

(30) Foreign Application Priority Data

Dec. 10, 2002 (EP) ..... 02447253

(51) Int. Cl.
*G21G 1/12* (2006.01)

(52) U.S. Cl. ..... 376/157; 376/156; 376/195; 250/492.1

(58) Field of Classification Search ..... 376/195, 376/194, 245, 156; 250/492.1
See application file for complete search history.

(56) References Cited

U.S. PATENT DOCUMENTS 2,868,987 A * 1/1959 Salsig, Jr et al. ..... 250/428
3,349,001 A * 10/1967 Stanton ..... 376/193
4,752,432 A 6/1988 Bida et al.
4,800,060 A 1/1989 Goldring
4,945,251 A 7/1990 Bechtold et al.
5,425,063 A 6/1995 Ferrieri et al.

(Continued)

FOREIGN PATENT DOCUMENTS

BE 1011263 A6 6/1999

(Continued)

OTHER PUBLICATIONS

Shaeffer et al., "Design of a 18F Production System at ORNL 86-Inch Cyclotron," ORNL/MIT-258 Oct. 19, 1977, pp. 1-16.*

(Continued)

*Primary Examiner* — Rick Palabrica
(74) *Attorney, Agent, or Firm* — Fitch, Even, Tabin & Flannery

(57) ABSTRACT

The present invention is related to a device and a method for producing a radioisotope of interest from a target fluid irradiated with a beam of accelerated charged particles, the device includes in a circulation circuit (17): an irradiation cell (1) having a metallic insert (2) able to form a cavity (8) designed to house the target fluid and closed by an irradiation window (7), the cavity (8) including at least one inlet (4) and at least one outlet (5); a pump (16) for circulating the target fluid inside the circulation circuit (17); an external heat exchanger (15); the pump (16) and the external heat exchanger (15) forming external cooling means of the target fluid; the device means for pressurizing (14) of the circulation circuit (17) and the external cooling means of the target fluid are arranged in such a way that the target fluid remains inside the cavity (8) essentially in the liquid state during the irradiation.

31 Claims, 6 Drawing Sheets

U.S. PATENT DOCUMENTS

| | | | | |
|---|---|---|---|---|
| 5,586,153 | A | 12/1996 | Alvord | |
| 5,917,874 | A | 6/1999 | Schlyer et al. | |
| 6,359,952 | B1 | 3/2002 | Alvord | |
| 6,567,492 | B2 * | 5/2003 | Kiselev et al. | 376/195 |
| 6,586,747 | B1 | 7/2003 | Erdman | |
| 6,917,044 | B2 * | 7/2005 | Amini | 250/492.1 |
| 7,200,198 | B2 * | 4/2007 | Wieland et al. | 376/195 |
| 2001/0040223 | A1 | 11/2001 | Fujiwara et al. | |
| 2004/0000637 | A1 | 1/2004 | Wieland | |
| 2004/0100214 | A1 | 5/2004 | Erdman | |
| 2005/0061994 | A1 | 3/2005 | Amini | |
| 2005/0084055 | A1 | 4/2005 | Alvord et al. | |
| 2005/0201504 | A1 | 9/2005 | Zeisler et al. | |

FOREIGN PATENT DOCUMENTS

| | | | |
|---|---|---|---|
| WO | 02/101758 | A1 | 12/2002 |
| WO | 02101757 | A | 12/2002 |

OTHER PUBLICATIONS

Wieland, "Foil Sealing Assembly used on 11 MeV Proton Targets," Proceedings of the First Workshop on Targetry and Target Chemistry, Heidelberg, West Geramny, Oct. 4-7, 1985, pp. 14-16.*

Kilbourn et al., "A Simple 16O Target for 18F Production", Int. J. Appl. Radiat. Inst. vol. 35, No. 7, pp. 559-602 (1984).*

Link et al., "Irradiation of Water to Improve the Specific Activity of Oxygen-15 Produced from Oxygen-16", IVth International Workshop on Targetry and Target Chemistry, Switzerland, pp. 148-150 (1991).*

Lindner et al., "Accelerator Production of 18F, 123Xe (123I), 211At and 38S", IAEA-SM-171/63, pp. 303-316 (1973).*

Morelle et al. "An Efficient [$^{18}$F] Fluoride Production Method Using a Recirculating $^{18}$ O Water Target" Proceedings of the Third Workshop onTargetry and Target Chemistry, Jun. 19-23, 1989, p. 50-51.

Patent Abstracts of Japan, JP 53046598, Apr. 26, 1978.

Wieland, et al. "Current Status of CTI Target Systems for the Producation of Pet Radiochemicals" Proceedings of the Third Workshop on Targetry and Target Chemistry, Jun. 19-23, 1989, p. 34-48.

Patent Abstracts of Japan, JP 09054196, Feb. 25, 1997.

Zeisler et al., "A water-cooled spherical niobium target for the production of [18F]fluoride", Applied Radiation and Isotopes 53 (2000) 449-453.

Buckley et al., "Improved yields for the in situ production of [11C]CH4 using a niobium target chamber", Nuclear Medicine and Biology 31 (2004) 825-827.

International Search Report, International Application No. PCT/BE2005/000025, completed on Jan. 25, 2006, 5 pages.

International Search Report, International Application No. PCT/BE2003/000217, completed on Mar. 30, 2004, 5 pages.

* cited by examiner

DEVICE AND METHOD FOR PRODUCING RADIOISOTOPES

FIELD OF THE INVENTION

The present invention relates to a device and to a method for producing radioisotopes, such as $^{18}F$, by irradiating with a beam of charged particles a target material which includes a precursor of said radioisotope.

One of the applications of the present invention relates to nuclear medicine, and in particular to positron emission tomography.

TECHNICAL BACKGROUND AND PRIOR ART

Positron emission tomography (PET) is a precise and non-invasive medical imaging technique. In practice, a radiopharmaceutical labelled by a positron-emitting radioisotope, in situ disintegration of which results in the emission of gamma-rays, is injected into the organism of a patient. These gamma-rays are detected and analyzed by an imaging device in order to reconstruct in three dimensions the biodistribution of the injected radioisotope and to obtain its tissue concentration.

Fluorine 18 ($T_{1/2}$=109.6 min) is the only one of the four light positron-emitting radioisotopes of interest ($^{13}N$, $^{11}C$, $^{15}O$, $^{18}F$) that has a half-life long enough to allow use outside its site of production.

Among the many radiopharmaceuticals synthesized from the radioisotope of interest, namely fluorine 18, 2-[$^{18}F$] fluoro-2-deoxy-D-glucose (FDG) is the radio-tracer used most often in positron-emission tomography. It allows the metabolism of glucose in tumours, in cardiology and in various brain pathologies to be analyzed.

The $^{18}F$ radioisotope is produced by bombarding a target material, which in the present case consists of $^{18}O$-enriched water ($H_2{}^{18}O$), with a beam of charged particles, more particularly protons. To produce said radioisotope, it is common practice to use a device comprising a cavity "hollowed out" in a metal part and intended to house the target material used as precursor.

The cavity in which the target material is placed is sealed by a window, called "irradiation window" which is transparent to charged particles of the irradiation beam. Through the interaction of said charged particles with the said target material, a nuclear reaction is generated which leads to the production of the radioisotope of interest.

The beam of charged particles is advantageously accelerated by an accelerator such as a cyclotron.

At the present time, because of an ever increasing demand for radioisotopes, and in particular for the $^{18}F$ radioisotope, it is requested to increase the yield of the nuclear reaction in order to always produce more radioisotope. This increase in production assumes either to modify the energy of the beam of charged particles (protons), and in this case make use of the dependence of thick target yield on the particle energy, or to modify the intensity of said beam, and in this case the number of accelerated particles striking the target material is modified.

However, the power dissipated by the target material irradiated by the accelerated particle beam limits the intensity and/or the energy of the particle beam that it is used.

This is because the power dissipated by a target material is determined by the energy and the intensity of the particle beam through the following equation (1):

$$P(\text{watts})=E(\text{MeV})\times I(\mu\text{A}) \quad (1)$$

where:

P=power expressed in watts;

E=energy of the beam expressed in MeV; and

I=intensity of the beam expressed in μA.

In other words, the power dissipated by a target material is therefore higher the higher the intensity and/or the energy of the particle beam.

It will consequently be understood that the energy and/or the intensity of the beam of accelerated charged particles cannot be increased without rapidly generating, within the cavity of the production device, and especially at the irradiation window, excessive pressures or temperatures liable to damage said window.

Moreover, in the case of $^{18}F$ radioisotope production, given the particularly high cost of $^{18}O$-enriched water, only a small volume of this target material, at the very most a few millilitres, is placed in the cavity. Thus, the problem of dissipating the heat produced by the irradiation of the target material over such a small volume constitutes a major problem to be overcome. Typically, for a volume of $^{18}O$-enriched water of 0.2 to 5 ml, the power to be dissipated is between 900 and 1800 watts for a 18 MeV proton beam with an intensity of 50 to 100 μA and for irradiation times possibly ranging from a few minutes to a few hours.

More generally, given this problem of heat dissipation by the target material, the irradiation intensities for producing radioisotopes are currently limited to 40 μA for an irradiated target material volume of 2 ml. Now, current cyclotrons used in nuclear medicine are, however, theoretically capable of accelerating proton beams with intensities ranging from 80 to 100 μA, or even higher. The possibilities afforded by current cyclotrons are therefore indubitably underexploited.

Solutions have been proposed in the prior art for overcoming the problem of heat dissipation by the target material in the cavity within the radioisotope production device. In particular, it has been proposed to provide means for cooling the target material.

Accordingly document BE-A-1011263 discloses an irradiation cell comprising a cavity sealed by a window, in which cavity the target material is placed, the said cavity being surrounded by a double-walled jacket allowing the circulation of a refrigerant for cooling said target material. Furthermore, it can be contemplated to cool the irradiation window by means of helium.

However, in that device, the target material is static, which gives said device configured in this way a number of drawbacks insofar as the heat dissipation in this configuration is physically limited due to the coefficient of heat exchange of the liquid with its container. Moreover, because of the high temperatures that are reached in the sealed cavity, the entire device must be pressurized. In fact, it is practically impossible to "monitor" the amount of $^{18}F$ produced in such a device, and the result, in terms of activity and yield, is therefore only known a posteriori.

It has also been proposed (in a publication by Jongen and Morelle, International Symposium "Proceedings of the third workshop on targetry and target chemistry", Vancouver, June 1989) to use a device in the form of circuit comprising an irradiation cell with a cavity containing a target material and an external heat exchanger in which the said $H_2{}^{18}O$ target material is recirculated so as to be cooled. This device, compared with that of the abovementioned prior art, therefore has the advantage of using a target material that can be termed "dynamic" since it is recirculated. Nevertheless, that device and method did not use pressurizing means so that the control of the pressure is a real problem in such a device. Moreover, said device and method were not explained in detail and are in practice prone to major technical implementation difficulties.

AIMS OF THE INVENTION

The present invention aims to provide a device and a method for producing a radioisotope of interest, such as $^{18}F$, from a target material irradiated with a beam of accelerated particles that do not have the drawbacks of the devices and methods of the prior art.

In particular, the present invention aims to provide a device and a method for producing a radioisotope of interest, such as $^{18}F$, from the irradiation of a target material ; which in this case consists of $^{18}O$-enriched water ($H_2{}^{18}O$), with a proton beam having a high current intensity, and preferably a current intensity greater than 40 μA.

It is another aim of the present invention to provide a device and a method which ensure a maximal heat exchange in operating conditions, that means during the irradiation and thus the production of said radioisotope of interest.

SUMMARY OF THE INVENTION

The present invention is related to a device for producing a radioisotope of interest from a target fluid irradiated with a beam of accelerated charged particles, said device comprising in a circulation circuit:

an irradiation cell comprising a metallic insert able to form a cavity designed to house the target fluid and closed by an irradiation window, said cavity comprising at least one inlet and at least one outlet;

a pump for circulating the target fluid inside the circulation circuit;

an external heat exchanger;

said pump and said external heat exchanger forming external cooling means of said target fluid;

said device being characterized in that it further comprises pressurizing means of said circulation circuit and the external cooling means of said target fluid are arranged in such a way that the target fluid remains inside the cavity essentially in the liquid state during the irradiation.

Preferably, said pump generates a flow rate sufficient to keep the target fluid at a mean temperature below 130° C.

Preferably, said pump generates a flow rate greater than 200 ml/minute.

Advantageously, said pump generates a flow rate greater than 500 ml/minute, preferably greater than 1000 ml/minute, and more preferably greater than 1500 ml/minute.

Preferably, in the device of the invention, said cavity is able to contain a volume of target fluid of between 0.2 and 5.0 ml.

Preferably, said device it is configured so as to contain in its circulation circuit an overall volume of the target fluid that is less than 20 ml.

Advantageously, the inlet and outlet are arranged in such a way as to create a vortex in the flow of the target fluid inside said cavity.

Preferably, one of the inlet or the outlet is positioned essentially tangentially to said cavity.

According to a first embodiment of the invention, the inlet and the outlet are located at the lateral surface of the cavity on the same meridian.

According to another embodiment of the invention, the accelerated charged particle beam hits the cavity window at an impact point and the target fluid inflow is directed at said impact point in such a manner that said inflow hits said window head-on with said beam.

In particular, according to an embodiment referenced detailed hereafter as the "second embodiment", the cavity presents a central axis around which a lateral surface is developed, the outlet being connected to said lateral surface and the inlet being along said central axis.

Furthermore, the device of the present invention the irradiation cell may comprise internal cooling means.

Preferably, said internal cooling means are in the form of a double-walled jacket surrounding said cavity.

Said internal cooling means may also be indirect cooling means of the cavity.

Preferably, the present device comprises Helium-based cooling means for cooling the irradiation window of the irradiation cell.

Another object of the invention concerns a method for producing a radioisotope of interest from a target fluid used as precursor of said radioisotope of interest irradiated inside an irradiation cell with a beam of accelerated charged particles, said irradiation cell comprising an metallic insert, able to form a cavity designed to house the target fluid and closed by an irradiation window, said cavity being provided with at least one inlet and at least one outlet;

said method being characterized in that said target fluid circulates inside in a circulation circuit which comprises in addition to the irradiation cell, at least a pump for the circulation of the material and an external heat exchanger;

said method being further characterized in that the pressure of the circuit is controlled by means of pressurizing means of said circulation circuit and in that said pump and said external heat exchanger are arranged in such a way that the target fluid remains inside the cavity essentially in the liquid state during the irradiation.

Preferably, in said method, a vortex in the flow of the target fluid is induced inside said cavity.

Preferably, the pump generates a flow rate sufficient to keep the target fluid at a mean temperature below 130° C.

Preferably, said pump generates a flow rate greater than 200 ml/minute, more preferably greater than 500 ml/minute. Advantageously, said pump generates a flow rate greater than 1000 ml/minute, and more advantageously greater than 1500 ml/min.

The present invention is also related to an irradiation cell comprising a metallic insert, able to form a cavity designed to house a target fluid and comprising at least one inlet and at least one outlet, said cavity being defined by a central axis around which a lateral surface is developed, and said cavity being closed by an irradiation window and being closed by a second surface essentially perpendicular to the central axis and opposed to the irradiation window, said irradiation cell being characterized in that the inlet is connected to said second surface essentially perpendicular to said central axis, while the outlet is connected to the lateral surface.

Another object of the present invention is the use of the device, of the method or of the irradiation cell of the invention as mentioned above for manufacturing a radiopharmaceutical compound, in particular devoted to medical applications such as positron emission tomography.

SHORT DESCRIPTION OF THE DRAWINGS

DETAILED DESCRIPTION OF SEVERAL PREFERRED EMBODIMENTS OF THE INVENTION

Figure 1:
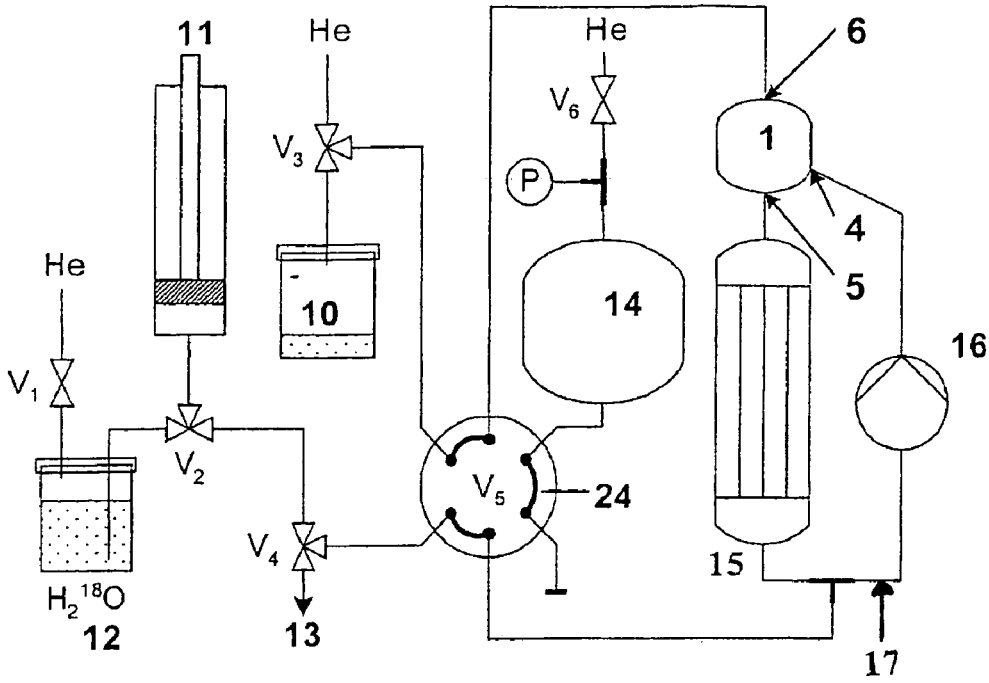
FIG. 1 represents a general diagramm of a device for producing the radioisotope of interest according to the method and the device of the present invention.

FIG. 1 discloses in general the operating principle of the device and method according to the invention. In particular, the device as detailed in FIG. 1 discloses a circulation circuit 17 for a target material. This circulation circuit comprises an irradiation cell having the general reference number 1 and which is detailed according to several embodiments in FIG. 2 to 4 and FIG. 5 to 8, respectively.

The principle on which the invention is based is that the target material circulates inside the circulation circuit and is submitted to irradiation inside the irradiation cell 1. This target material enters inside said cell 1 via an inlet 4 and goes out of said cell through an outlet 5. In order to allow such a circulation, a pump 16, preferably a high-output pump, is mounted in the circulation circuit 17.

According to the present invention, pressurizing means of the circuit are also provided.

The pressurizing means are generated in the embodiment example illustrated in FIG. 1 via a "gas cushion" operating as an expansion tank 14 which allows the whole circuit 17 to be pressurized.

Finally, according to the present invention, an external heat exchanger 15 is also provided in the circulation circuit 17 of the target material.

The assembly corresponding to these elements, i.e. the external heat exchanger 15 and the pump 16, is arranged is such a manner that during the irradiation, the target material which is a fluid, in circulation inside the circuit, and more particularly in circulation inside said cell 1, is kept in an essentially liquid state. This assembly is defined as the external cooling means of the target material.

In other words, according to the present invention, the configuration of the external means for cooling the target material compared with the other elements of the device is such that it allows, when the device is in operation, i.e. during irradiation, the target material to move within the circulation circuit 17 at a speed high enough to allow sufficient heat exchange inside the heat exchanger 15.

Particularly, not only the speed but also the pressure have to be defined in such a way that the mean temperature of the material circulating within the circulation circuit 17 is lower than a threshold temperature. This temperature is usually lower than 130° C.

Preferably, a second outlet 6 is also provided in order to eliminate the overflow of the target material. This outlet 6 is connected to a expansion tank 14.

This device further comprises a target material tank 12, a tank receiving the overflow 10 and a syringe device 11. An outlet 13 leading to the chemical synthesis module is also provided. The different elements are connected together by valves which allow or prevent the circulation of the target material within the device.

In the present embodiment example, the production of the $^{18}$F radioisotope obtained from a target material consisting of $^{18}$O-enriched water and submitted to an irradiation by a proton beam is decribed. In the present case, the outlet is a module for the synthesis of radiopharmaceuticals, such as a FDG module.

Figure 2:
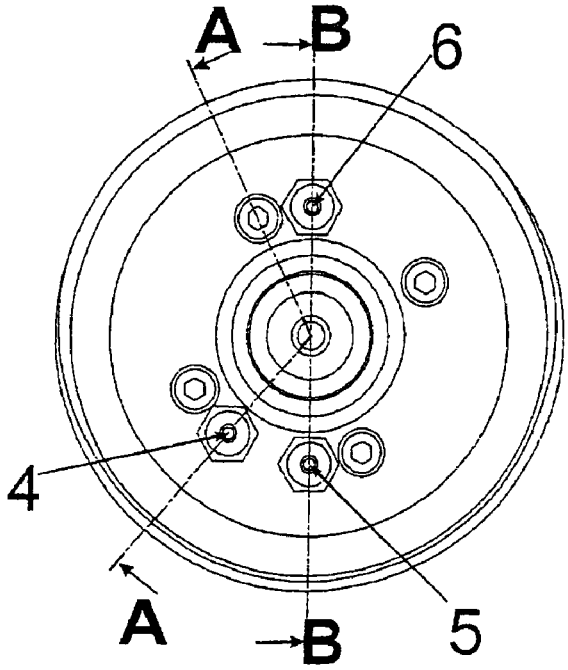
FIG. 2 represents according to a first embodiment, a view from the back of an irradiation cell used in the method and device according to the present invention.
Figure 3:
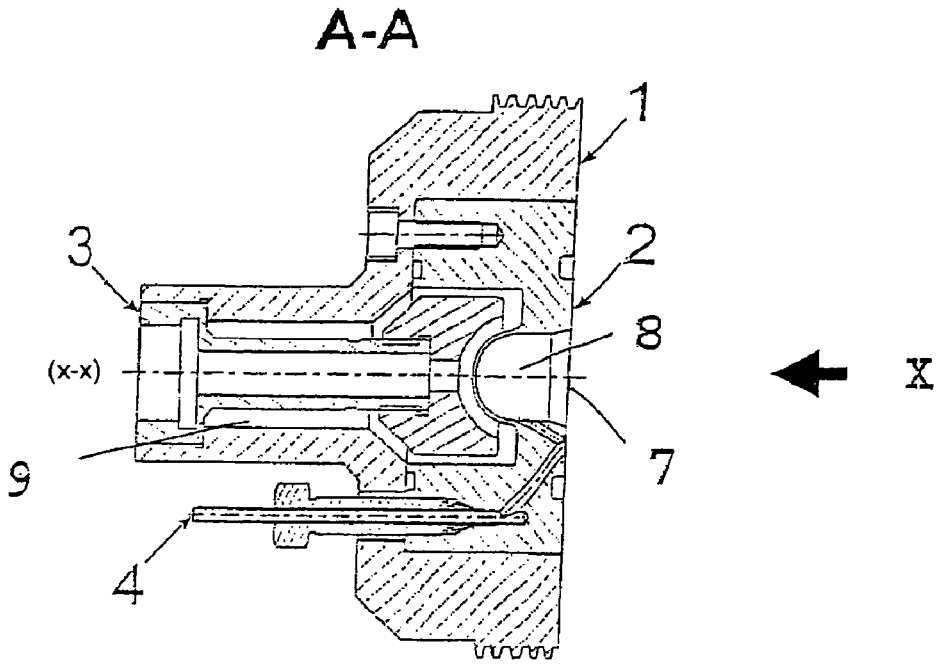
FIG. 3 and FIG. 4 represent longitudinal sectional view respecetively along the A-A and B-B planes of the irradiation cell, as disclosed in FIG. 2.
Figure 4:
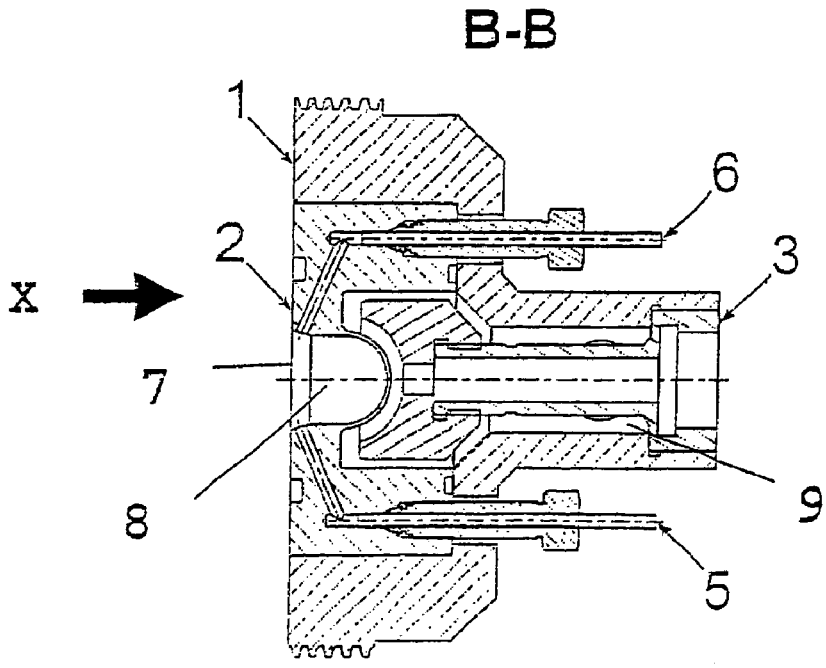

A first embodiment of the irradiation cell 1 is disclosed in FIG. 2 to 4 and corresponds to the mechanical assembly which, during operation of said device, is subjected to an accelerated particle beam irradiation on the target material in order to produce the radioisotope of interest.

The irradiation cell 1, as represented in FIG. 2 to 4, comprises an insert 2 which consists in one or more metallic parts (elements) arranged so as to create a volume corresponding to an irradiation cavity 8.

The insert 2 therefore includes the cavity 8, this cavity has a configuration such that it can house the target material which is subjected to the bombardment of the accelerated particle beam. For this purpose, said cavity is closed (sealed) by an irradiation window 7 transparent to the accelerated particle beam.

The irradiation cell also comprises an inlet 4 and an outlet 5 allowing the target material to enter the irradiation cell and get out of it. The inlet and outlet provide the inflow and outflow of the target material or vice versa, depending on the direction of circulation within the circuit.

What is important in the present invention is to generate a flow vortex which is essentially turbulent within said cavity. In other words, in said invention, it is meant by "flow vortex" a hollow whirl which is generated in certain conditions in a flowing fluid.

For this purpose, according to the embodiment shown in FIG. 2 to 4, a first duct which is either the inlet duct or the outlet duct, is located essentially tangentially to said cavity. It is meant by "essentially tangentially" the fact that the first duct, which is the inlet duct, makes an angle of lower than 25°, and preferably lower than 15°, relatively to said physical tangent at its junction point with the cavity.

The direction of the accelerated particle beam is represented by the arrow X in said figures.

According to this embodiment, the inlet duct 4 and outlet ducts 5 and 6 are all located at the periphery of the irradiation cell, and more precisely along a "meridian". This means that at least the ducts 4 and 5 are arranged side by side along an imaginary meridian and therefore do not lie in the same transverse plane. Similarly, there is a difference between the inclination angle of the first duct at the junction point with the cavity and the inclination angle of the second duct at the junction point with said cavity. This configuration allows to create a flow vortex which prevents the generation of stagnation areas inside said cavity.

Furthermore, in an advantageous manner, in order to avoid an excessive heating of the target material within the cavity, internal cooling means inside the cavity are provided. These means are represented by the ducts 9 through which a refrigerating fluid may flow through the entrance 3.

Figure 5:
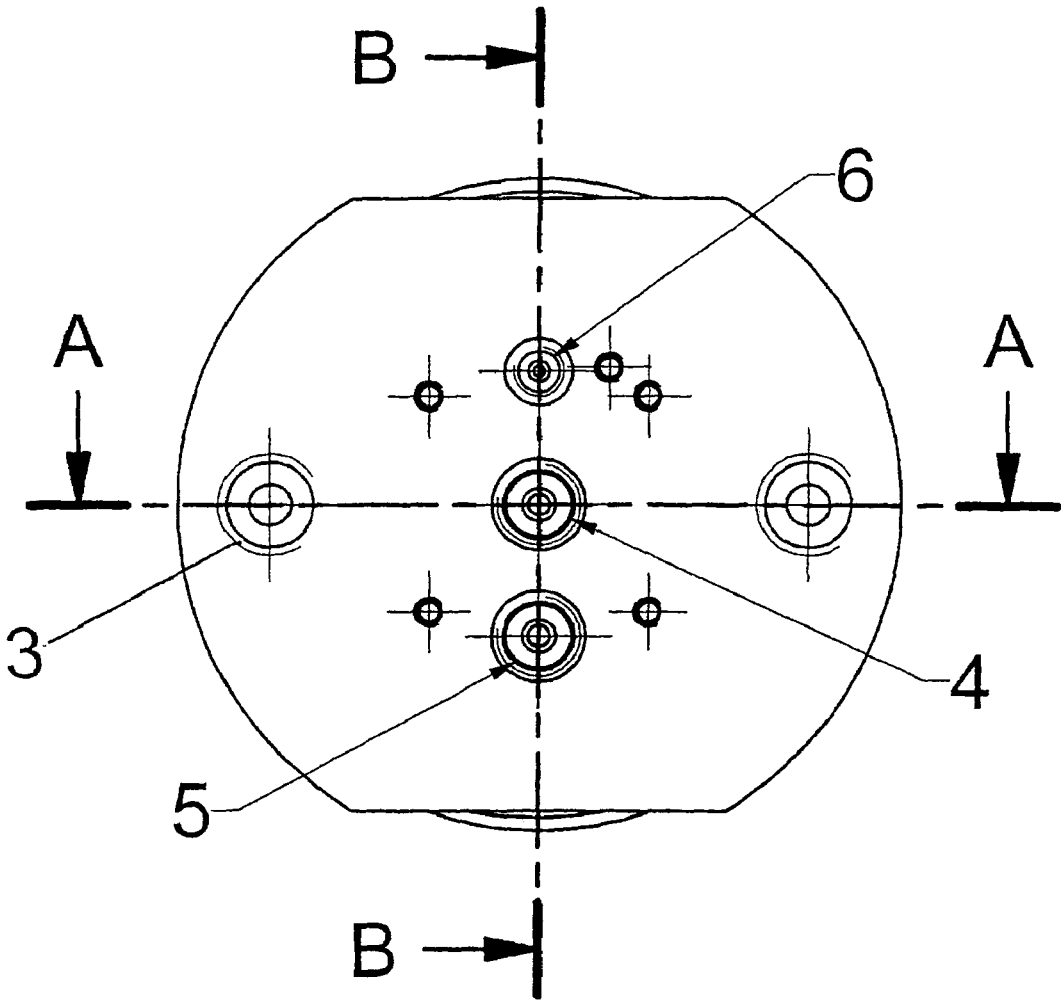
FIG. 5 shows according to a second embodiment, a view from the back of an irradiation cell used in the method and device according to the present invention.
Figure 6:
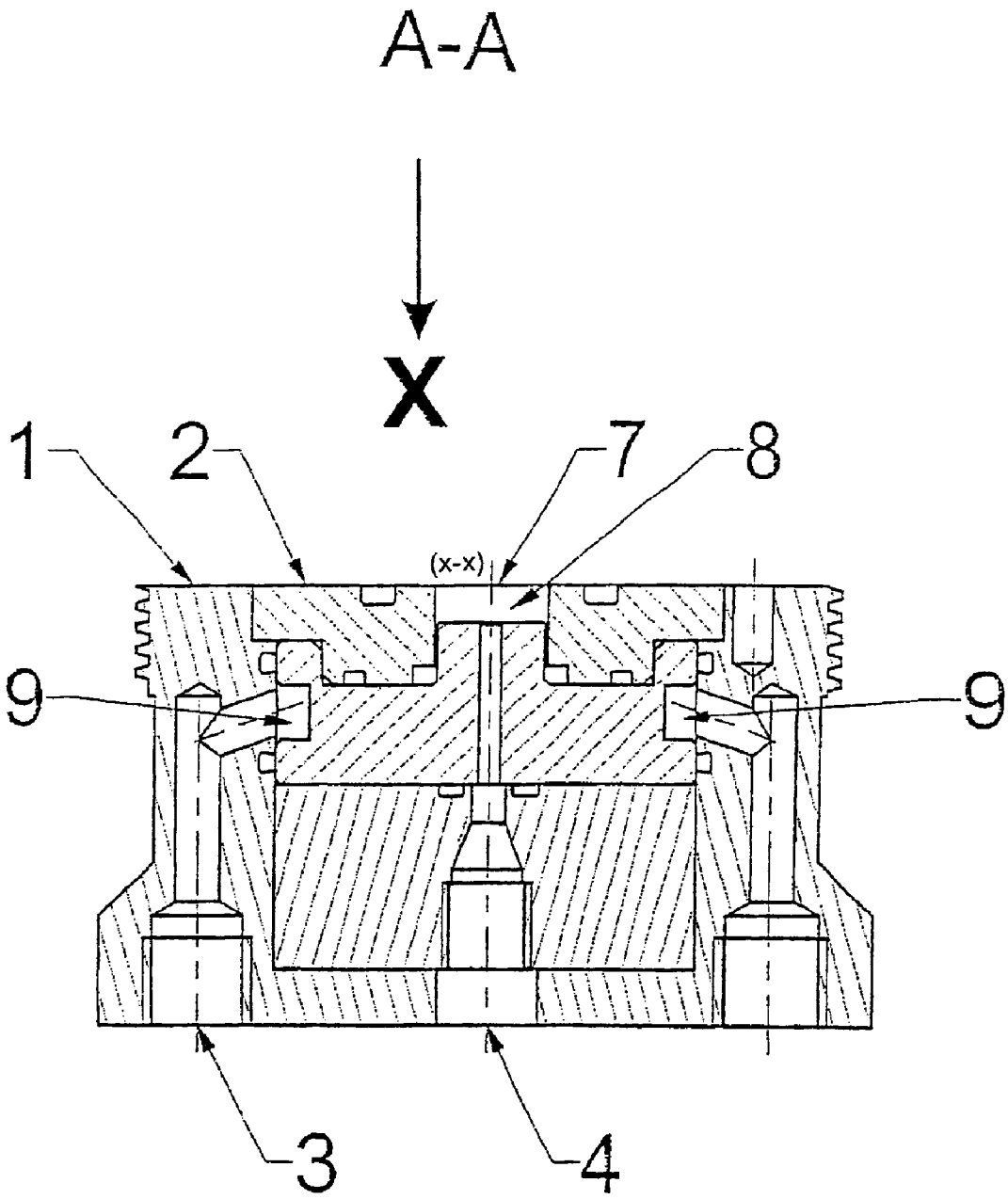
FIG. 6 and FIG. 7 represent longitudinal sectional view respectively along the A-A and B-B planes of the irradiation cell as disclosed in FIG. 5.
Figure 7:
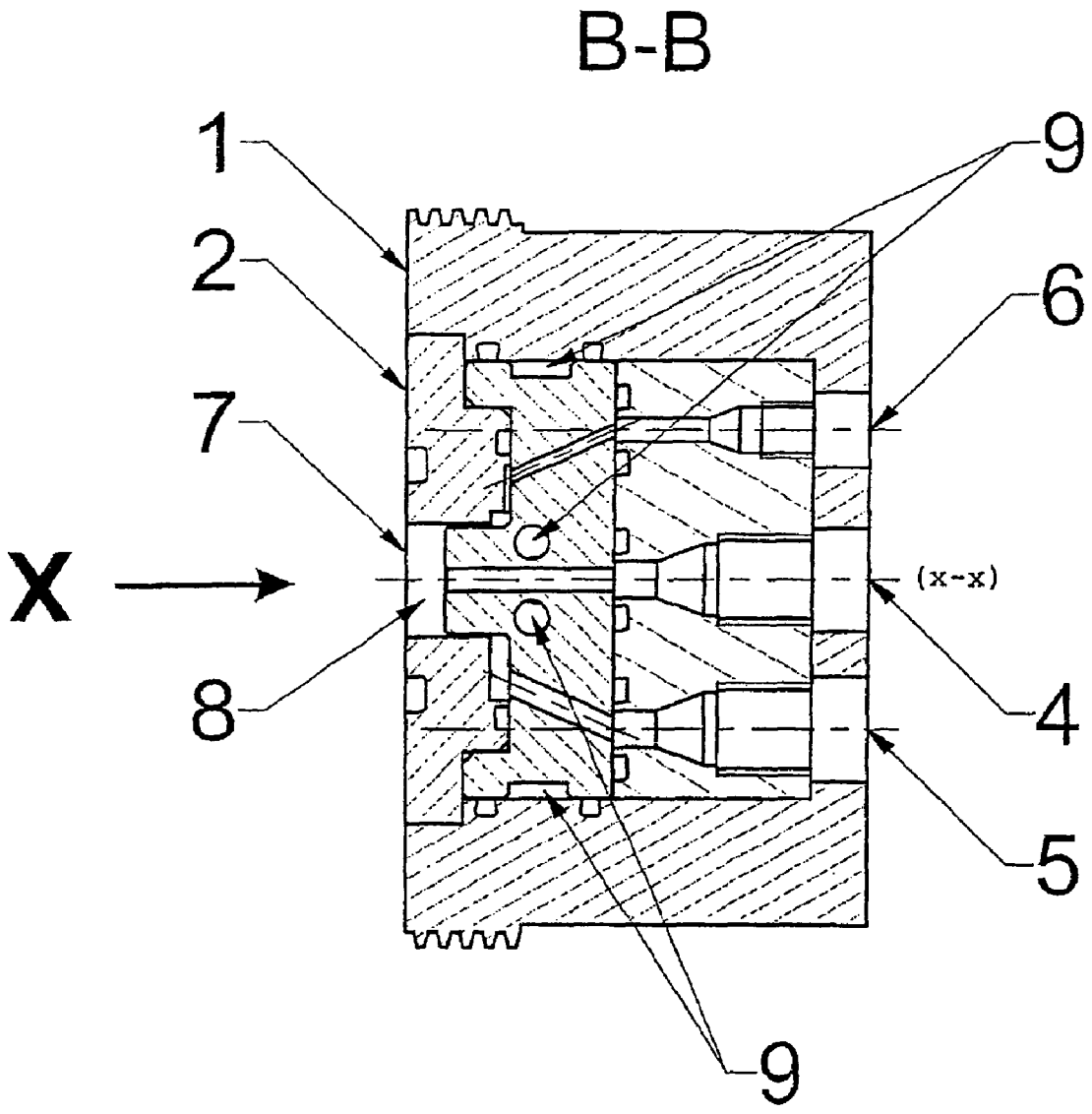
Figure 8:
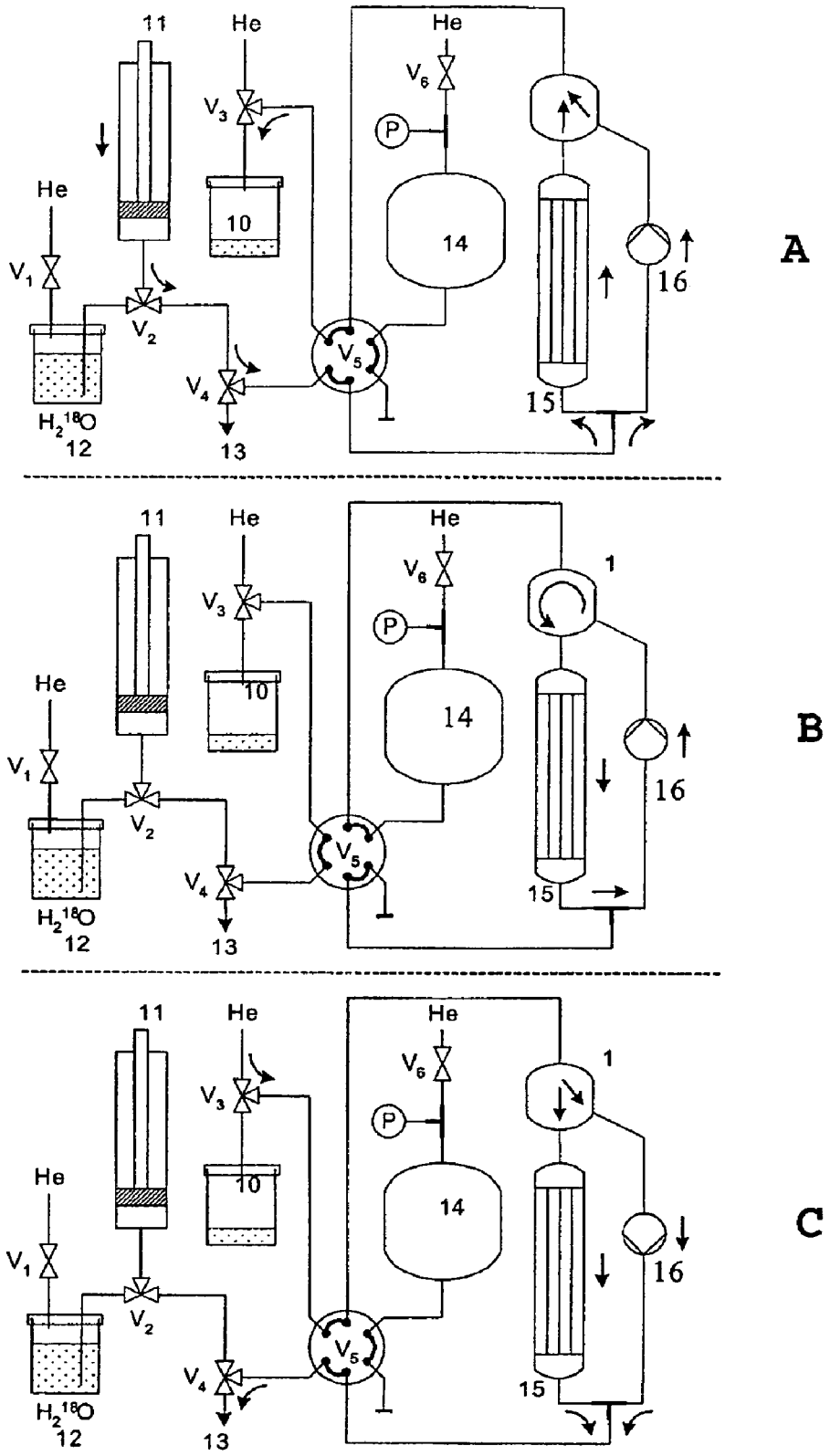
FIG. 8A, 8B, 8C represent respectively the proceedings for filling the irradiation cell, operating said cell during irradiation, and draining outside the cell after irradiation.

According to a second embodiment detailed in FIG. 5 to 7, the inlet 4 is located approximately in the direction of the impact point of the accelerated particle beam X, i.e. said inlet 4 corresponds essentially to the central symmetry axis (x-x) of the irradiation cell 1, while the outlet ducts 5 and 6 are located at the edge (periphery) of said cell.

This embodiment allows to create a vortex inside said cavity, again essentially without stagnation areas. Furthermore, the fact that the inlet duct is located approximately facing the impact point of the beam allows a displacement tolerance of about 1 mm for said beam.

Moreover, in a particularly advantageous way, this second embodiment allows to give a symmetric circulation to the target material within said cavity 8. Similarly, the fact that the inlet duct 4 is facing the irradiation window in the opposite direction of the irradiation beam X allows to induce a cooling of said window and thus prevent an excessive heating of the window by the accelerated particle beam.

According to this configuration it is necessary that the inlet duct corresponds to the axial duct 4 while the outlet duct corresponds to the peripheral duct 5 or 6, and not the contrary.

According to both embodiments presented in FIG. 2 to 7, internal cooling means of the target material are generally provided in the irradiation cell. Typically and as disclosed in document BE-A-1011263, internal cooling means 9 can be provided in the form of a double-walled jacket which surrounds the irradiation cell and allows the circulation of refrigerating fluid as represented in FIGS. 3 and 4.

According to the second embodiment described in FIG. 5 to 7, internal cooling means 9 of the indirect type can advantageously be provided. This means that it is the insert 2 or some of its elements that are cooled. No direct or close contact is therefore provided between the cavity 8 and said internal cooling means 9.

According to the embodiment described in FIG. 5 to 7, the flow rates and pressures can be optimized so as to be totally independent of the presence of internal cooling means 9.

Similarly, cooling means using gaseous helium may be provided to cool the irradiation window 7. In this case, it is proposed to use a double window made of Havar having a total thickness of between 50 and 200 μm as an irradiation window.

According to the second embodiment, it is also possible not to use such window cooling means. In this case, it is proposed to use a simple window having a thickness between about 25 μm and about 50 μm as an irradiation window.

It should noted that another embodiment of the device according to the invention can also be envisaged, wherein the accelerated charged particle beam hits the cavity window 7 at an impact point and the inlet 4 is such that the target fluid inflow is directed at said impact point in such a manner that said inflow hits said window head-on with said beam. It means that in said embodiment, on the contrary to the second embodiment mentioned above, it is not necessary that the impact point of the accelerated particle beam has a direction which essentially coincides with the central axis (x-x) of the cavity 8. In other words, the second embodiment as mentioned above has to be considered as a particular case of said other embodiment, which is more general.

The materials for manufacturing the device according to the present invention have to be selected in a cautious way. Advantageously, they are selected so as to be resistant to radiation and pressure. Similarly, they have to be chemically inert relatively to fluoride ions. By way of example, the external heat exchanger 15 may be formed from pipes made of silver or any other materials that are chemically inert and resistant to radiation and pressure. For this application, copper cannot be used and niobium appears to be difficult to machine. Silver and/or titanium are therefore the best compromise; it is possible to use tantalum and/or palladium for making certain parts of the device.

Similarly, the choice of the insert material is particularly important. It is indeed necessary to avoid the production of undesirable by-products during irradiation. By way of example, it is necessary to avoid the production of radioisotopes that disintegrate by high-energy gamma particle emission and give by-products that have an influence on the subsequent synthesis of the radio-tracer to be labelled by the radioisotope. For example, Ti gives $^{48}V$ which has no negative secondary effect on synthesis, while on the contrary, Ag produces no gamma ray but chemical disturbance.

In addition, when choosing the type of material for the inserts of the device according to the invention, another key parameter is its thermal conductivity. Thus, silver is a good conductor but does have the drawback that, after several irradiation operations, it forms silver compounds that can be contaminant.

Titanium is chemically inert but produces $^{48}V$ having a half-life of 16 days. Consequently, in the case of titanium, should a target window break its replacement would pose serious problems for the maintenance engineers who would be exposed to the ionizing radiation.

Finally, it is also possible to use niobium for the insert, this material being two and a half times more conducting than titanium, but less conducting than silver. Nb produces few isotopes of long half-life.

The overall activity of the insert 2, measured after irradiation and total emptying of said insert has to be as low as possible.

In the examples described according to the two above-mentioned embodiments, the radioisotope production device is used for producing $^{18}F$ from $^{18}O$-enriched water and subjected to a proton beam with energies of between 5 and 30 MeV, a beam intensity ranging from 1 to 150 μA and an irradiation time ranging from one minute to ten hours.

In these examples, the enriched water must have a minimal flow rate of 200 ml per minute but this flow rate can easily reach values of about 500 ml per minute or even higher values for the first embodiment, while this flow rate can easily reach values of about 1000 ml per minute, and more preferably 1500 ml per minute, or even higher values for the second embodiment. Such flow rates can be obtained, for example, through the use of a pump such as the Series 120 pump supplied by Micropump Inc. This gear pump equipped with a gear set N21 is capable of delivering 900 ml/min at a pressure of 5 to 6 bar. Another example of usable pumps is the pump corresponding to the model TS057G.APPT.G02.3230 of the Tuthill company and which is capable of delivering a flow rate of about 1100 ml/min at a differential pressure of 6 Bar.

The overall volume of target contained in the entire device of the invention must not exceed 20 ml, which means that the dead volume of the pump must be used as low as possible.

The external heat exchanger 15 that also contains a very small volume of target material, normally less than 10 ml, and preferably less than 5 ml, is generally connected to a secondary cooling circuit (not shown) for dissipating the heat produced by the irradiation of the target liquid in the irradiation cell 1.

The irradiation cell 1 is necessarily positioned along the axis of the incident beam. The materials of which it is made must therefore be able to withstand the ionizing radiation. However, it is possible to place the pump 16, the external heat exchanger 15 and the valve $V_5$ so that they are offset in order to be protected from this radiation. The Applicant has been able to devise a solution in which these components may be protected from the ionizing radiation by the flux return of the cyclotron magnet, but without the length of the lines exceeding 20 cm as a result.

Various forms of exchanger well known to those skilled in the art may be used. Without being restricting, we mention coil exchangers or exchangers with a double-walled pipe or else a tube exchanger or plate exchanger. The only constraints on such an exchanger are a very small dead volume, not exceeding a few ml, an extremely low head loss and, of course, maximized heat-exchange capacity (between 1 and 2.5 kW) while being resistant to acid pH values (of between 2 and 7), to $^{18}O$-enriched water and to other products resulting from the irradiation.

In summary, the device according to the invention allows radioisotopes to be produced from a target material irradiated by a beam of charged particles produced by a cyclotron. Thanks to its design, the device according to the invention has the advantage of optimizing the use of the irradiation capacity of present-day cyclotrons. This is because, although the irradiation windows 7 as known in the art do not currently withstand pressures resulting from irradiation currents greater than 45 μA, the device according to a preferred embodiment does, however, allow the use of the maximum currents available on the cyclotrons presently used in nuclear medicine, that is to say about 100 μA.

In general, the device makes it possible to use the maximum capacity of present-day cyclotrons that can produce irradiation currents exceeding 100 μA, while still controlling the temperature rise. The target therefore remains essentially in the liquid state, allowing it to be recirculated at high speed without depriming of the pump.

The fact of being able to irradiate a target material with 80 μA rather than 40 μA allows more $^{18}F$ to be produced, which is economically very advantageous.

FIG. 8A, B, C show the conveying, production and draining means of the target material in the irradiation cell. The valve $V_6$ allows a backpressure of helium, argon or nitrogen to be provided, in order to form a "gas cushion" operating as an expansion tank. The helium, argon or nitrogen makes it possible in general to pressurize the entire circuit, especially via the valves $V_1$ and $V_3$. The valves $V_2$ and $V_4$ are used for filling the system.

The invention claimed is:

1. A device which produces a radioisotope from a target fluid irradiated with a beam of accelerated charged particles, the device including a circulation circuit, the circulation circuit comprising:

an irradiation cell which comprises a metallic insert;

a pump effective for generating flow of the target fluid and circulating the target fluid inside the circulation circuit;

an external heat exchanger; and a pressurizing device which pressurizes the circulation circuit, the pump and the external heat exchanger forming a cooling device external to the irradiation cell, the cooling device effective for cooling the target fluid and retaining the target fluid inside the cavity during irradiation a liquid state, the metallic insert comprising a cavity which receives the target fluid, an inlet conduit and two outlet conduits which permit the inflow and outflow, respectively, of the target fluid into and out of the cavity as the target fluid moves in the circulation circuit, an irradiation window which is substantially planar and positioned perpendicularly to the accelerated particle beam, the inlet conduit having a longitudinal central axis generally central to the insert and perpendicular to the substantially planar irradiation window, and the inlet configured to direct the target fluid inflow through the center of the insert and (1) perpendicular to the irradiation window and (2) to an impact point of the accelerated charged particle beam in the irradiation window so that the inflow hits the window head-on with the beam, the outlet conduits to either side of the inlet conduit, each outlet having a cavity exit portion extending from the cavity, the cavity exit portion of each outlet conduit having a longitudinal central axis, each longitudinal central axis of the cavity exit portion of the outlet conduits intersecting the central longitudinal axis of the inlet and forming angles with the central longitudinal axis of the inlet and which angles cause a turbulent vortex in the flow of the target fluid inside the cavity.

2. The device according to claim 1, wherein the pump is configured to provide a flow rate sufficient to keep the target fluid at a mean temperature below 130° C.

3. The device according to claim 1 wherein the pump is configured to provide a flow rate greater than 200 ml/minute.

4. The device according to claim 3, wherein the pump is configured to provide a flow rate greater than 500 ml/minute.

5. The device according to claim 1, wherein the cavity is configured to contain a volume of target fluid of between 0.2 and 5.0 ml.

6. The device according to claim 1, wherein the overall volume of the target fluid in the circulation circuit is less than 20 ml.

7. The device according to claim 1, wherein the cavity has a central axis around which a lateral surface is developed, the outlet being connected to the lateral surface and the inlet being along the central axis.

8. The device according to claim 1, wherein the irradiation cell further-comprises an internal cooling device effective for cooling the target material.

9. The device according to claim 8, wherein the internal cooling device provides indirect cooling of the cavity.

10. A method for manufacturing a radiopharmaceutical compound, the method comprising utilizing the device according to claim 1.

11. The device according to claim 3, wherein the pump is configured to provide a flow rate greater than 1000 ml/minute.

12. A device which produces a radioisotope from a target fluid irradiated with a beam of accelerated charged particles, the device including a circulation circuit, the circulation circuit comprising:

an irradiation cell which comprises a metallic insert;

a pump effective for generating a flow of the target fluid and circulating the target fluid inside the circulation circuit;

an external heat exchanger; and a pressurizing device which pressurizes the circulation circuit, the pump and the external heat exchanger forming a cooling device which cools the target fluid to retain the target fluid inside the cavity during irradiation in the liquid state, and the metallic insert comprising a cavity which receives the target fluid, an inlet and two outlet conduits which permit inflow and outflow, respectively, of the target fluid into and out of the cavity as the target fluid moves in the circulation circuit, an irradiation window which is substantially planar and positioned perpendicularly to the accelerated charged particle beam, the inlet conduit having a longitudinal central axis generally perpendicular to the substantially planar irradiation window, and the inlet conduit configured to direct the target fluid inflow (1) perpendicular to the irradiation window and (2) to an impact point of the accelerated charged particle beam in the irradiation window so that the inflow of the target fluid hits the window head-on with the beam, the outlet conduits on opposite sides of the inlet conduit, each outlet having a cavity exit portion that exits the cavity, the cavity exit portion of each outlet conduit having a longitudinal central axis intersecting the central longitudinal axis of the inlet and forming an angle with the longitudinal central axis of the inlet conduit, each angle between the central axis of the inlet conduit and the central axis of each of the outlet conduits less than 25° to cause a turbulent vortex in the flow of the target fluid inside the cavity.

13. The device according to claim 12, wherein the pump is configured and arranged to provide a flow rate sufficient to keep the target fluid at a mean temperature below 130° C.

14. The device according to claim 12, wherein the pump is configured and arranged to provide a flow rate greater than 500 ml/minute.

15. The device according to claim 12, wherein the irradiation cell further comprises an internal cooling device effective for cooling the target material.

16. The device according to claim 1, wherein the cavity has a volume of at least 5 ml.

17. The method according to claim 10, wherein the cavity is configured to contain a volume of target fluid of between 0.2 and 5.0 ml.

18. The method according to claim 10, wherein the overall volume of the target fluid in the circulation circuit is less than 20 ml.

19. The method according to claim 10, wherein the pump is configured and arranged to provide a flow rate sufficient to keep the target fluid at a mean temperature below 130° C.

20. The method according to claim 10, wherein the pump is configured and arranged to provide a flow rate greater than 500 ml/minute.

21. The method according to claim 10, wherein the pump is configured and arranged to provide a flow rate greater than 1000 ml/minute.

22. The device according to claim 1 wherein the internal cross section of one outlet conduit is larger than the other outlet conduit.

23. The device according to claim 12 wherein the exit portion of one outlet conduit has an internal cross section and the exit portion of the other outlet conduit has an internal cross section and one internal cross section is larger than the other internal cross section.

24. A device which produces a radioisotope from a target fluid irradiated with a beam of accelerated charged particles, the device including a circulation circuit, the circulation circuit comprising:

an irradiation cell which comprises a metallic insert;

a pump effective for generating flow of the target fluid and circulating the target fluid inside the circulation circuit;

an external heat exchanger; and a pressurizing device which pressurizes the circulation circuit, the pump and the external heat exchanger forming a cooling device external to the irradiation cell, the cooling device effective for cooling the target fluid and retaining the target fluid inside the cavity during irradiation a liquid state, the metallic insert comprising a cavity which receives the target fluid, an inlet conduit and two outlet conduits which permit the inflow and outflow, respectively, of the target fluid into and out of the cavity as the target fluid moves in the circulation circuit, an irradiation window which is substantially planar and positioned perpendicularly to the accelerated particle beam, the inlet conduit having a longitudinal central axis generally central to the insert and perpendicular to the substantially planar irradiation window, and the inlet configured to direct the target fluid inflow through the center of the insert and (1) perpendicular to the irradiation window and (2) to an impact point of the accelerated charged particle beam in the irradiation window so that the inflow hits the window head-on with the beam, the outlet conduits to either side of the inlet conduit, each outlet having a cavity exit portion that exits the cavity, the cavity exit portion of each outlet conduit having a longitudinal central axis, each longitudinal central axis of the cavity exit portion of the outlet conduits forming acute angles with the central longitudinal axis of the inlet and which acute angles cause a turbulent vortex in the flow of the target fluid inside the cavity.

25. The device according to claim 24 wherein the exit portion of one outlet conduit has an internal cross section and the exit portion of the other outlet conduit has an internal cross section and one internal cross section is larger than the other internal cross section.

26. The device according to claim 24, wherein the pump is configured and arranged to provide a flow rate sufficient to keep the target fluid at a mean temperature below 130° C.

27. The device according to claim 24, wherein the pump is configured and arranged to provide a flow rate greater than 500 ml/minute.

28. The device according to claim 24, wherein the irradiation cell further comprises an internal cooling device effective for cooling the target material.

29. The device according to claim 24, wherein the cavity has a volume of at least 5 ml.

30. The device according to claim 24, wherein the cavity is configured to contain a volume of target fluid of between 0.2 and 5.0 ml.

31. The device according to claim 24, wherein the overall volume of the target fluid in the circulation circuit is less than 20 ml.

* * * * *